United States Patent [19]

Stark

[11] 4,119,971

[45] Oct. 10, 1978

[54] HIGH DATA RATE FREQUENCY SCAN SLOTTED WAVEGUIDE ANTENNA

[75] Inventor: Louis Stark, Fullerton, Calif.

[73] Assignee: Hughes Aircraft Company, Culver City, Calif.

[21] Appl. No.: 765,464

[22] Filed: Feb. 4, 1977

[51] Int. Cl.[2] ..... H01Q 13/10

[52] U.S. Cl. ..... 343/768; 343/771; 343/854

[58] Field of Search ..... 343/768, 771, 854

[56] References Cited

U.S. PATENT DOCUMENTS

| | | | |
|---|---|---|---|
| 2,676,257 | 4/1954 | Hebenstreit | 343/771 |
| 3,434,139 | 3/1969 | Algeo | 343/768 |
| 3,438,035 | 4/1969 | Fling et al. | 343/768 |

OTHER PUBLICATIONS

Croney; Doubly Dispersive Frequency Scanning Antenna; Microwave Journal; Jul. 1963, pp. 76, 77, 78, 79, 80.

*Primary Examiner*—Eli Lieberman

*Attorney, Agent, or Firm*—J. A. Cardenas; John Holtrichter, Jr.; W. H. MacAllister

[57] ABSTRACT

A frequency scan antenna utilizing either parallel or series beam spoiling for increasing the radar beam width and increasing the data rate is disclosed. As a radar beam is scanned from the horizon to a maximum altitude or angle above the horizon, the beam width is broadened or spoiled, thereby allowing a higher data rate collection and storage. A first embodiment according to the present invention utilizes coaxial cables of incrementally varying lengths connecting the delay line with an array of parallel line source radiators. The cables having the minimum length are connected at the extreme radiators while the maximum length cables are connected at the center line source radiators. The wavefront is bowed and a greater sector in space may be scanned. A second embodiment of the present invention utilizes a delay line with unequal tap spacings which is series coupled to the array of line source radiators. The time and consequently the phase delay of the signal applied to the delay line increases toward the upper radiators by incrementally increasing the length of the delay line segments coupled to subsequent radiators.

4 Claims, 9 Drawing Figures

HIGH DATA RATE FREQUENCY SCAN SLOTTED WAVEGUIDE ANTENNA

FIELD OF THE INVENTION

The present invention relates to microwave antennas, and in particular to frequency scan antennas having improved data rate characteristics.

PRIOR ART

Frequency scan antennas are well known in the prior art, so too are phase scan antennas which have been used to increase the data rate capability of a surveillance radar. Generally, inertialess frequency scanning antennas have included an array of parallel line source radiators which receive their energy from a sinuous delay line at one end of the parallel array. The antenna array and the delay line are rotated for scanning in azimuth and the parallel array is electrically scanned in frequency in elevation. Assuming the lowest frequency scans the horizon, the wavefront from the antenna is parallel to the antenna or orthogonal to the plane of the horizon. As the antenna is energized by higher frequencies the wavefront of the radiated energy is tilted up for scanning angles above the horizon. The wavefront is merely tilted up as the higher frequencies are applied to the antenna.

Another method utilized has been to provide phase shifters to broaden the beamwidth of the radiated signal. Heretofore, phase scanning antennas have utilized electronic phase shifters to broaden the beam width of an antenna as a volume in space is scanned from the horizon to some maximum altitude or angle. The prior art phase scanning antennas include a controllable ferrite phase shifter connected in series between the waveguide delay line and each of the parallel radiators. This just-described antenna is costly, heavier, and temperature sensitive due to the ferrite phase shifters. In addition, the phase shifters require computer control which in turn increases the cost.

OBJECTS AND SUMMARY OF THE INVENTION

Accordingly, it is an object of the present invention to provide a frequency scan antenna which is simple, reliable and accurate.

It is another object of the present invention to provide an improved frequency scan antenna having an improved data rate.

It is still another object of the present invention to provide a frequency scan antenna having improved scanning speed in one plane.

In accordance with the above objects, a high data rate frequency scan antenna includes an antenna array having a plurality of parallel microwave radiators for inertialess frequency scanning in a preselected plane. Delay line means receive microwave energy from a microwave source and provide the energy to the parallel microwave radiators so that the beam width from the totality of radiators varies with frequency in accordance with a frequency sensitive phase curvature.

DETAILED DESCRIPTION OF THE DRAWINGS

Figure 1:
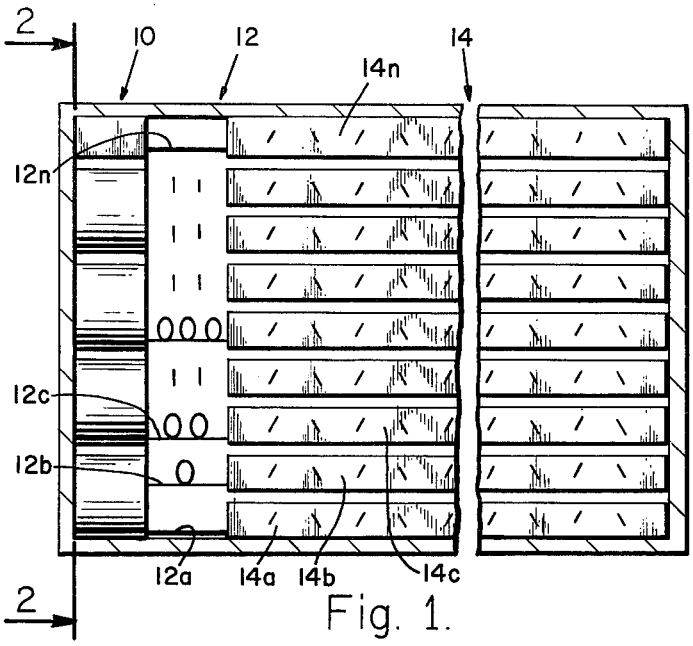
FIG. 1 is a front view of a frequency scan antenna array according to a first embodiment of the present invention.

Referring now more specifically to FIG. 1, the first embodiment of a high data rate frequency scan antenna includes a sinuous waveguide delay line 10 which receives microwave energy from a microwave source such as a transmitter (not shown). The waveguide delay line 10 has a series of apertures, each located an integral number of wavelengths apart or $n\lambda_0$, where $\lambda_0$ is the beam-normal wavelength at the center frequency. Adjacent apertures are located an integral wavelength distance apart if there is no natural phase reversal to the physical geometry of a folded waveguide. If there is such a phase reversal, the delay line length between adjacent apertures may be designed with a length of $(n-\frac{1}{2})x\lambda_0$. Other methods may also be utilized to compensate for the 180° phase reversal.

A plurality of incrementally varied length coaxial cables 12*a, b, c . . . n* connect each aperture of the waveguide delay line 10 to a plurality of parallel linear waveguides 14*a, b, c . . . n,* respectively, which comprise a planar array antenna 14. The linear waveguide 14*a, b, c,* etc., each have a plurality of slotted radiating elements in the plane of the antenna.

The length of each cable 12*a, b . . .* is determined by the data rate desired, which in turn is determined by the breadth of the beams from the antenna array 14. The beam width from an antenna array scanning up in elevation may be increased, thereby allowing a greater amount of space to be scanned in less time with the same probability in detecting a target as a narrow pencil beam signal at the horizon. For example, the length of the coaxial cable 12*a* connecting the first delay line segment 10*a* with the first radiating element 14*a* may be one wavelength long. The second coaxial cable 12*b* connecting the waveguide delay line 10*b* and the radiating element 14*b* may be an integral number of wavelengths long in accordance with the equation discussed below. In general the cable lengths are tailored to match the ordinates of the cosine function, to within the nearest wavelength. Since the beam is broadened, a greater volume in space is scanned in a given unit of scan time of the antenna. The third coaxial cable 12*c* connecting the third segment of the delay line 10 to the third radiating element 14*c* is an integral number of wavelengths longer than the second coaxial cable 12*b*. The coaxial cable connecting the center delay line segment with the central radiating line source has the maximum length for maximum phase error at frequencies away from the horizon frequency. The coaxial cables connecting the segments in the upper half of the delay line 10 with the radiating elements in the upper half of the antenna array 14 are the same length as the corresponding cables in the lower half. Thus, if the energy into the microwave delay line 10 is swept up in frequency the wavefront emitted by the antenna array 14 is made to conform with the phase curve induced by the coaxial cables 12. And since the radiating energy travels perpendicular to the wavefront, the beam from the antenna is thereby broadened.

Figure 2:
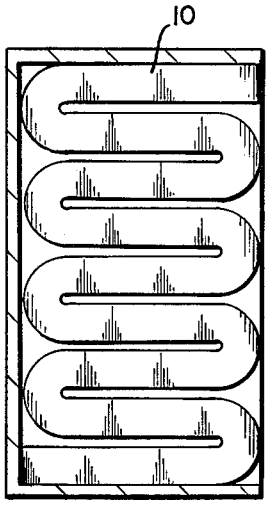
FIG. 2 is a sectional view of the side of a frequency scan antenna about the line 2—2 of FIG. 1.

Referring now briefly to FIG. 2, a sectional view of an antenna array illustrates the sinuous delay line 10 which receives microwave energy from the transmitter and provides that energy to the antenna array 14. It is noted that the length of each segment or waveguide section between adjacent line source radiators is equal. In other words the length of each segment is a predetermined number of wavelengths long at the center frequency of the antenna. The second embodiment described below utilizes a delay line 10 which has unequal and progressively increasing or decreasing length waveguide segments.

Figure 3:
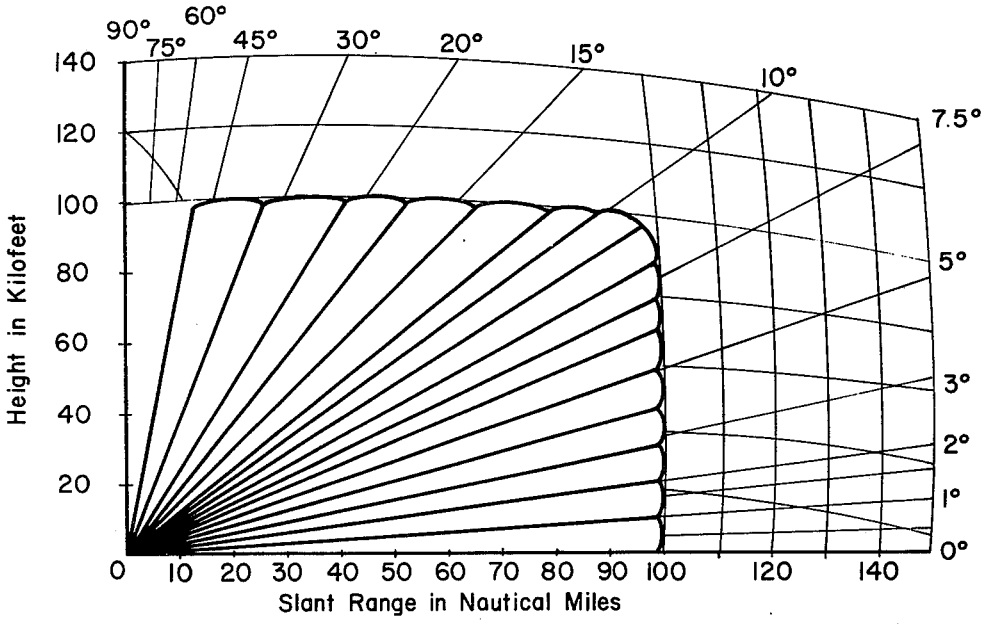
FIG. 3 is a graph illustrating a radar coverage of a beam spoiling frequency scan antenna.

Air surveillance radars employ a rotating frequency scan array antenna in order to provide height information in addition to the range and azimuth that would be available from a simple fan beam radar. Coverage is provided by frequency scanning a narrow pencil beam rapidly in elevation as the antenna rotates at constant speed and azimuth. The linear radiating elements have a differential phase imparted between them in the vertical direction by the frequency scanning feed incorporating phase spoiling according to the present invention. A typical radar coverage diagram in elevation is shown in FIG. 3. For the example shown, the maximum range of the radar is 100 miles and the target ceiling altitude is 100,000 feet. Elevation angular coverage is limited by the antenna maximum scan angle capability and is shown here as 50°. A narrow pencil beam is scanned from the horizon up to the target elevation ceiling and thereafter the beam width may be broadened, since the target range decreases. Alternately the beam may be broadened from the horizon to a maximum elevation. One rule for beam broadening is to provide an energy density such as to maintain a constant signal strength or constant probability of detection on a target flying at constant maximum altitude. This rule results in an envelope of the gain function following a $\csc^2\theta$ curve and the beam width broadens according to the same rule. Another rule would be to provide constant position accuracy of the target at all elevation angles as determined by the beam width and the signal-to-noise ratio, since the $\csc^2$ rule provides degraded accuracy at high angles. As required by either cases, it is possible to achieve significant beam broadening in a frequency scanned array by the added use of passive coaxial cables. By so broadening the beam, the time taken to scan through the elevation coverage is reduced to a minimum. Since the beam broadens as the beam is scanned up, the time to search the total elevation angle is decreased as compared with that for an antenna having stepped beams of the same narrow width as that on the horizon.

For purposes of discussion, let us define a standard or reference radar which has a one degree minimum beam width on the horizon. Let the maximum range be 100 miles and the elevation ceiling be 100,000 feet. If we assume that successive beams in the scan are crossed over at their 3 dB points and the beam is broadened by the $\csc^2\theta$ rule after reaching elevation ceiling, then by summing the ranging times for all beams it is readily found that the time to scan the entire volume is 6 seconds. If, however, beam spoiling according to the present invention were not employed, the time would increase to 11 seconds. The relatively higher data rate is one of the important advantages of beam spoiling. It is evident that the total scan time varies directly with the maximum range and inversely with the beam width. The height accuracy varies inversely with the beam width. It should be noted that the angular accuracy degrades as the beam is broadened; however, since the range is decreased at angles where the beam is wider, the absolute position accuracy in linear dimension tends to remain constant. Thus as the wavefront is tilted up for scanning angles above the horizon by varying the frequency, the beam width is also increased as a function of frequency.

Figure 4A:
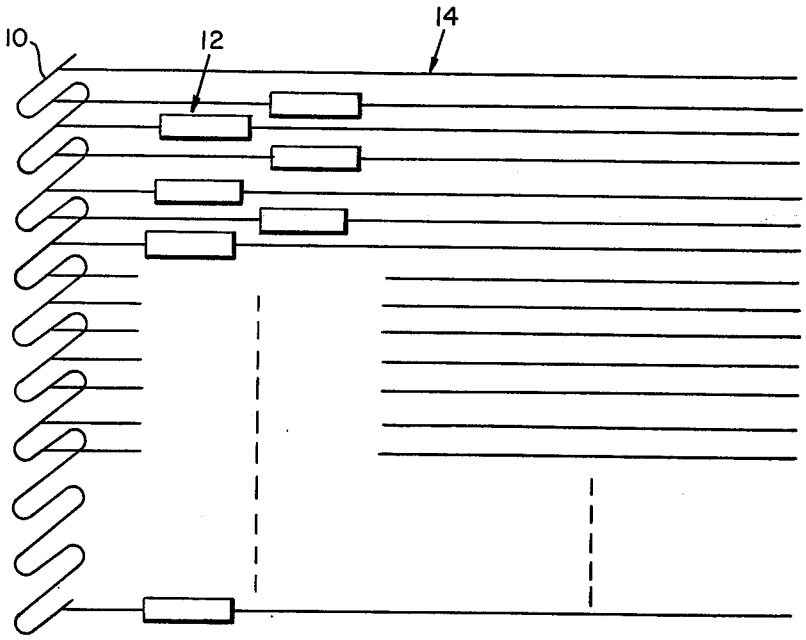
FIGS. 4*a* and 4*b* are schematic block diagrams representative of the first embodiment of the present invention.
Figure 4B:
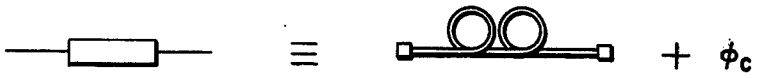

Referring briefly to FIG. 4*a*, the schematic block diagram illustrates the plurality of coaxial cables 12 connecting the waveguide delay line 10 and the radiating elements of the antenna array. FIG. 4*b* defines the phase error delay networks coupled between the sinuous delay waveguide and the antenna array as a coaxial cable plus phase delays ($\phi_c$) which are constant with frequency.

Figure 5:
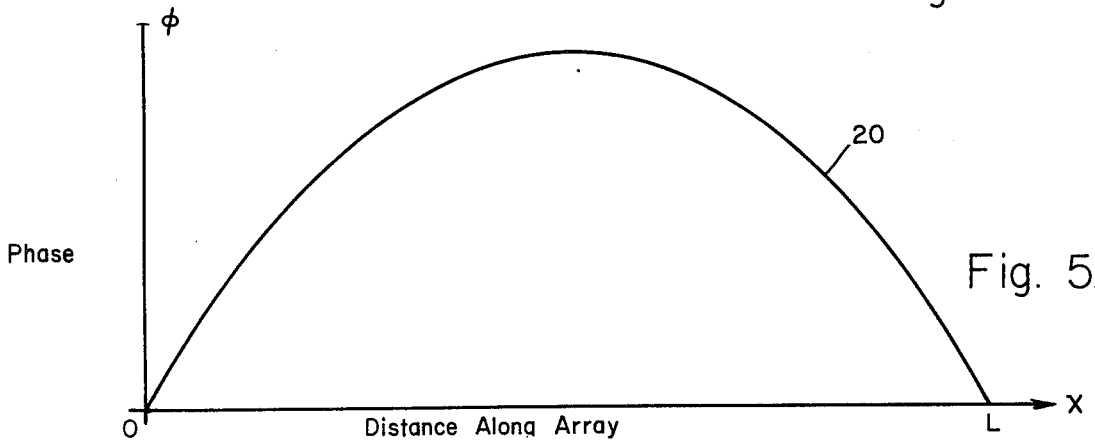
FIG. 5 is a graph diagram illustrating a typical beam broadening or phase error curve according to the first embodiment of the present invention.

FIG. 5 is a graph representing typical beam broadening curves according to the present invention. Curve 20 corresponds to the equation $$\phi = \phi_m \cos\pi \frac{x}{L}$$

where $\phi$ is the phase error at a distance X from one edge of the antenna array 14. $\phi_m$ is the maximum phase error. Other curves similar to curve 20 may be used for determining the beam spoiling function for a radar.

The preferred method of determining coaxial cable lengths is to taper the lengths precisely according to the ordinates of the cosine loop. At the horizon frequency, each linear array is brought into phase with a constant phase shift phase shifter. Then the phase error curve is precisely a cosine function whose amplitude is proportional to frequency. As an example, to obtain a 720° phase error at 6% from the horizon frequency, the center cables would be about 33 wavelengths long at the horizon frequency. At S-band an air dielectric cable would accordingly be 11 feet long, which would probably be accommodated in sizes of $\frac{5}{8}$ inch diameter or less. The gain reduction function with elevation scan using the above method would not precisely be the ideal $\csc^2\theta$ function. It may also be seen that the cable lengths need not be precisely determined according to the ordinates of the cosine curve, but the cable lengths may be incrementally increased in steps to the nearest wavelength (at the horizon frequency) for accomplishing the beam broadening.

Figure 6:
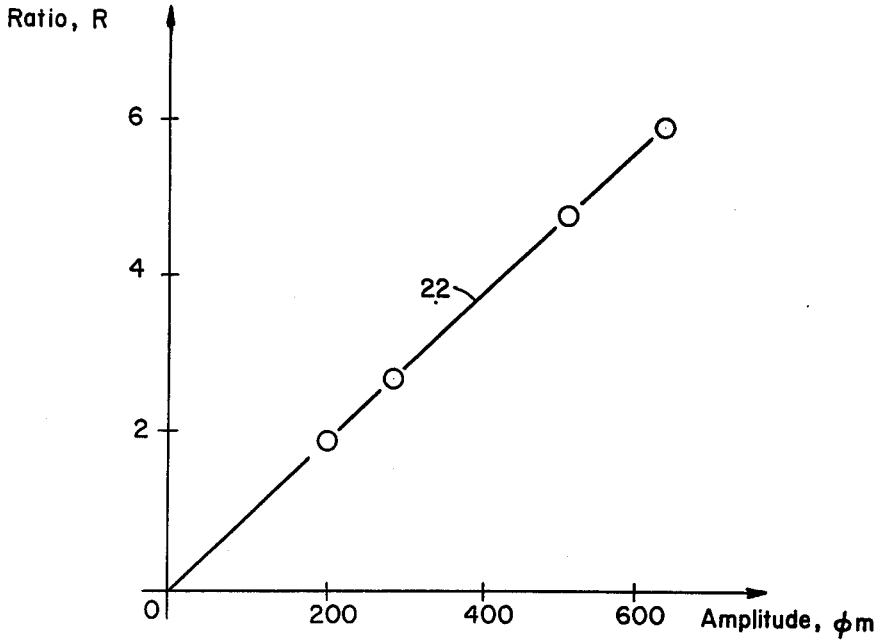
FIG. 6 is a graph representing typical beam broadening curves which may be utilized in the present invention.

Referring now more specifically to FIG. 6, the curve 22 represents a graph of the ratio of the maximum beam width to the minimum beam width with respect to the amplitude of the beam broadening curve, i.e. maximum phase error angle.

Figure 7:
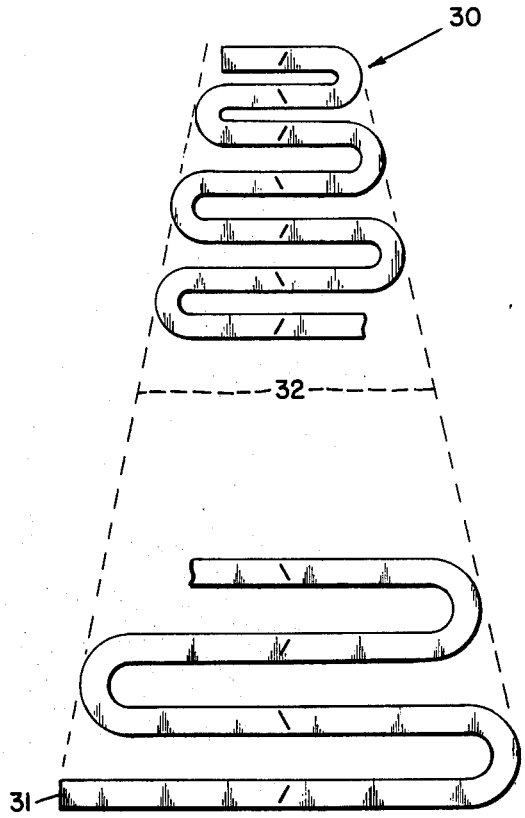
FIG. 7 is a front view of a waveguide delay line according to the second embodiment of the present invention.

FIG. 7 is a front view of a waveguide delay line 30 according to a second embodiment of the present invention. In the second embodiment it is the delay line which provides the phase error functions. The waveguide segments of the delay line are seen to increase incrementally from one end to the other. As the delay line is "swept" in frequency the phase of the signals from the slotted apertures are varied such that the wavefront is curved and thus the beam is broadened.

The input port 31 to the delay line 30 may be located at the longest segment of the delay line 30 and there is a slotted output port associated with each of the delay line segments. The envelope 32 of the delay line 30 may be two nonparallel straight lines or it may be a parabolic shape depending upon the bandwidth, the degree of phase error to be introduced along with the rate of phase error divergence. The shape or envelope of the delay line 30 may be empirically determined by first determining the segment lengths for the central segments. For example, the center segment may be $x$ wavelengths long at the center frequency. Then the longest segment may be $x + \Delta$ wavelengths long where $\Delta$ is an integer. Once the center and longest delay line segments are chosen the smallest segment is thereby determined if linear nonparallel curves constitute the boundary envelope. With such linear boundaries the radar signal has a parabolic shaped phase error curve. The incremental increase in length between adjacent segments is determined by the phase shift vs. frequency that is desired to be radiated by the antenna array. Thus, in lieu of utilizing additional components such as coaxial cables, the delay line 30 may provide the dual function of "feeding" the antenna and providing the proper phase curve.

Figure 8:
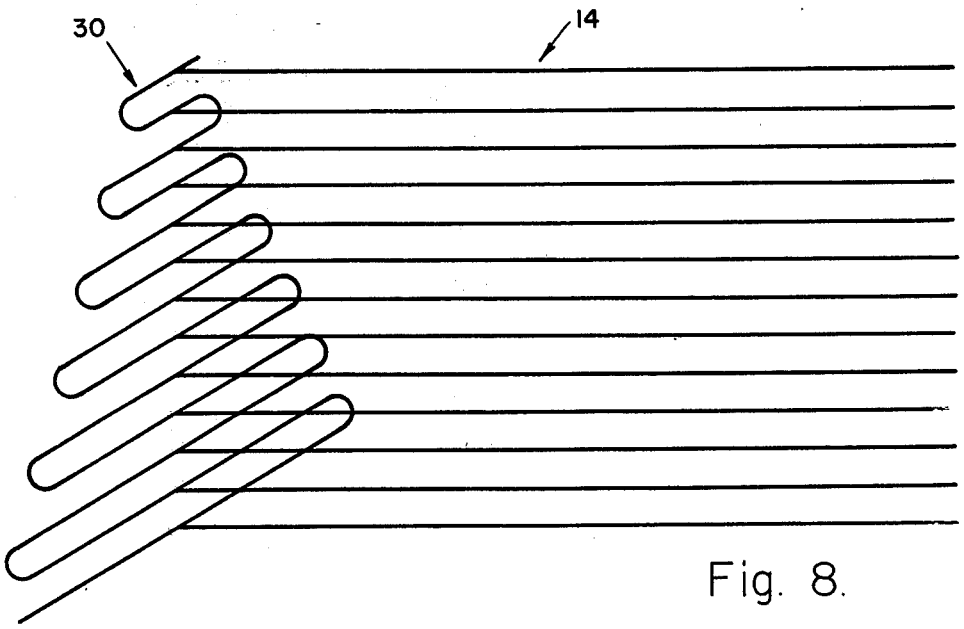
FIG. 8 is a schematic block diagram illustrating the second embodiment according to FIG. 7.

FIG. 8 is a schematic block diagram of the second embodiment of the present invention and illustrates the ever-increasing segment lengths of the waveguide delay line connected to respective radiating elements of the antenna structure 14.

Although the invention has been shown and described with reference to particular embodiments, nevertheless, various changes and modifications obvious to one skilled in the art to which the invention pertains are deemed within the purview of the invention.

What is claimed is:

1. An improved frequency scanning antenna providing a faster scan capability comprising:

means for receiving a frequency varying signal for frequency scanning in one plane;

delay means coupled to said receiving means for providing a signal having a predetermined phase error function in response to said frequency varying signal for providing predetermined beam broadening as said frequency changes in a predetermined manner, said beam being narrow at a first angle of scan in said plane and progressively becoming broader as said frequency approaches a second angle of scan on said plane;

parallel linear array antenna means for providing a plurality of output signals, each successive signal having an incrementally varying beam width in response to said delay line means for frequency scanning in said plane in decreased scan time.

2. The invention according to claim 1 further comprising said receiving means being a sinuous feed waveguide having a plurality of equally spaced output ports;

a plurality of signal conducting means coupled to respective output ports of said sinuous feed waveguide and said parallel linear array antenna means, the length of each of said signal conducting means varying incrementally from the preceding signal conducting means in a predetermined manner so that the phase of each succeeding linear array antenna means is varied in a predetermined manner for scanning a progressively broader antenna beam by said plurality of parallel linear array antenna means from said first scan angle to said second scan angle.

3. An improved frequency scanning antenna according the claim 2 wherein said plurality of signal conducting means comprise:

a plurality of coaxial cables whose lengths (L) are determined by each cable's position ($x$) within said plurality and whose output signal phase ($\phi$) is determined by the total phase error ($\phi_m$) of said antenna according to:

$$\phi = \phi_m \cos \pi \frac{x}{L}.$$

4. The invention according to claim 1 wherein said delay means comprise waveguide means for receiving a frequency varying signal and providing a phase and frequency varying signal, said waveguide means having a plurality of series connected segments individually coupled to said respective parallel linear array antenna means for providing signals having predetermined frequencies and phases thereto, respectively, each of said segments varying incrementally in length over the preceding segment in a predetermined manner for providing a narrow antenna beam at said first angle of scan and a broad antenna beam at said second angle of scan, said individual segments for inducing an antenna phase error corresponding to frequency.

* * * * *